US005168646A

United States Patent [19]

Dippong et al.

[11] Patent Number: 5,168,646

[45] Date of Patent: Dec. 8, 1992

[54] VISUAL EFFECT GRAPHIC AND METHOD OF MAKING SAME

[75] Inventors: John Dippong, Addison; Gerald R. Sorensen, Elgin, both of Ill.

[73] Assignee: NCM International, Inc., Chicago, Ill.

[21] Appl. No.: 798,011

[22] Filed: Nov. 20, 1991

Related U.S. Application Data

[63] Continuation of Ser. No. 532,270, Jun. 1, 1990, abandoned.

[51] Int. Cl.[5] ..... G09F 13/00

[52] U.S. Cl. ..... 40/442; 40/427; 428/30

[58] Field of Search ..... 40/442, 427, 443, 444, 40/453; 428/30; 272/61

[56] References Cited

U.S. PATENT DOCUMENTS

| | | | |
|---|---|---|---|
| 734,135 | 7/1903 | Porter | 428/30 |
| 1,607,922 | 11/1926 | Schweitzer . | |
| 2,221,889 | 11/1940 | White . | |
| 2,345,998 | 4/1944 | Apuzzo . | |
| 2,560,392 | 7/1951 | Latrobe | 40/442 |
| 2,700,919 | 2/1955 | Boone . | |
| 2,850,824 | 9/1958 | Searles . | |
| 2,882,631 | 4/1959 | Boone . | |
| 3,218,926 | 11/1965 | Boone . | |
| 3,250,913 | 5/1966 | Welty . | |
| 3,312,006 | 4/1966 | Rowland . | |
| 3,365,350 | 1/1968 | Cahn . | |
| 3,661,385 | 5/1972 | Schneider | 40/427 X |
| 3,736,832 | 6/1973 | Franke et al. . | |
| 3,745,678 | 6/1973 | Thomassen . | |
| 3,806,722 | 4/1979 | Peake et al. . | |
| 3,852,145 | 12/1974 | Kloweit | 40/616 |
| 3,868,501 | 2/1975 | Barbour . | |
| 4,067,129 | 1/1978 | Abramson et al. . | |
| 4,164,823 | 8/1979 | Marsico . | |
| 4,475,791 | 10/1984 | Nixon . | |
| 4,542,449 | 9/1985 | Whitehead . | |
| 4,545,007 | 10/1985 | Nagel . | |
| 4,649,462 | 3/1981 | Dobrowolski et al. . | |
| 4,652,979 | 3/1987 | Arima . | |
| 4,755,921 | 7/1988 | Nelson . | |
| 4,798,448 | 1/1989 | van Raalte . | |
| 4,823,246 | 4/1989 | Dilouya . | |
| 4,890,201 | 12/1989 | Toft . | |
| 4,922,384 | 5/1990 | Torrence . | |

FOREIGN PATENT DOCUMENTS

| | | | |
|---|---|---|---|
| 1216185 | 2/1959 | France | 428/30 |
| 656213 | 8/1951 | United Kingdom | 40/442 |

*Primary Examiner*—Kenneth J. Dorner
*Assistant Examiner*—Brian K. Green
*Attorney, Agent, or Firm*—Wallenstein, Wagner & Hattis, Ltd.

[57] ABSTRACT

A method of creating apparent motion on a two-dimensional surface, the surface being illumination responsive to a directed moving reference of light source. The method comprising the steps of devising on a tracing sheet at least one pattern of apparent motion to be created on the surface. Dividing the pattern into a plurality of discrete and spatially related zones. Next a direction of apparent motion to be created within each zone is determined. The pattern and zones thereof are then transferred onto the surface of a light responsive deformable material. On the surface is found a plurality of grooves corresponding to each zone. The grooves in the direction of apparent motion are progressively angled relative to the directed moving reference of light source from about 90 degrees through about 180 degrees. Finally, the surface is illuminated with the directed moving reference of light source to produce at least one illumination response within each zone and thereby create apparent motion between adjacent zones.

11 Claims, 2 Drawing Sheets

VISUAL EFFECT GRAPHIC AND METHOD OF MAKING SAME

This is a continuation of co-pending application Ser. No. 07/532,270, filed on Jun. 1, 1990, now abandoned.

TECHNICAL FIELD OF THE INVENTION

The present invention generally relates to visual effects graphics and displays and, in particular, to a method of creating and controlling the illusion of apparent motion or floating three-dimensional illusion in an illumination responsive two-dimensional graphic.

BACKGROUND OF THE INVENTION

Illumination responsive graphics which create a visual illusion or effect are often used in merchandising or to convey information or an aesthetic effect. Such graphics frequently convey the illusion of apparent motion on a two-dimensional surface. To create the illusion of apparent motion, prior art visual effect graphics emboss or engrave the surface with ridges or grooves to receive varying angles of illumination incidence due to use of a moving reference of light source. The ridges or grooves reflect the illumination at varying and changing angles of reflection. With such varying and change reflection angles, illumination is either directly reflected back to a viewer, which the viewer perceives as a bright spot of illumination, or illumination is scattered or dispersed which the viewer perceives as a darker area on the graphic surface. The transitions from bright to dark create an illusion of motion among related regions of the graphic surface. An example of such visual displays are disclosed in U.S. Pat. Nos. 3,806,722 and 4,067,129.

A problem with such prior art visual effect graphics is that they rely entirely on selective movement of the light source without consideration of the direction of apparent movement being created on the surface of the graphic. Further, no consideration is given to the direction and angle of light reflection relative to the direction and angle of incidence of illumination. Hence, the light perceived by the viewer is randomly scattered and dispersed and often cancelled out due to interference. As a result, the illusion of apparent motion is not clearly conveyed by the graphic.

Further, the viewer may perceive that the graphic cyclically pulses or flickers which further interferes with the illusion of apparent motion. Apparently, this is due to the non-directed engraving or embossing on the graphic surface, which as mentioned above, increases random scattering and dispersion of light to diminish the visual effect of the graphic.

In addition, it is believed that prior art visual effect graphics fail to adequately control the moving light source. Typically, the individual elements or bulbs of the light source are either completely on or completely off. This causes conditions of brightness or darkness which contributes to the cyclical flickering or pulsing of the entire visual graphic as the light source moves about the periphery of the display.

Hence, prior to the present invention, a need existed for a graphic visual display for use in merchandising or for information or aesthetic purposes which clearly conveys apparent motion yet controls the illumination of various zones on the graphic surface. A need further existed to control the direction and speed of apparent motion to eliminate the undesirable visual effects of prior art displays.

SUMMARY OF THE INVENTION

According to the present invention, a method of creating apparent motion on two-dimensional illumination responsive graphics has been developed which overcomes the problems of the prior art. The method of the present invention not only dictates the direction of apparent motion on various zones on the surface of the graphic, but also the speed of apparent motion or floating three-dimensional illusion conveyed by the graphic.

Generally, the method of the present invention includes devising on a tracing sheet at least one pattern of apparent motion to be created by the graphic surface. Next, the pattern is divided into a plurality of discrete, yet spatially related zones. Within each zone, the direction of apparent motion to be created is determined both individually and relative to the apparent motion to be created within adjacent zones. Preferably, this step also includes determining the frequency or speed or apparent motion within each zone. In all embodiments of the present invention, this is practiced by plotting within each zone at least one vector conceptually representing direction and speed of apparent motion. The tail of the vector represents a region of the zone of maximum illumination response, the body of the vector representing a decreasing illumination response and the head or tip of the vector representing a region of the zone of minimum illumination response. The speed of apparent motion within a zone can be increased by plotting more than one vector within a zone in either head-to-tail, head-to-head or tail-to-tail conformations. This increases the frequency of transitions from maximum illumination response to minimum illumination response through spatially adjacent regions within each zone.

After plotting on the tracing sheet vectors for determining the direction and speed of apparent motion within each zone of the pattern, the tracing sheet is overlaid onto the surface of a deformable illumination responsive material, such as a waxed foil or a deformable transparent or translucent plastic. The pattern and zones are then transferred onto the waxed foil surface. Next grooves are formed on the surface corresponding to each zone by embossing or engraving the deformable material using techniques known in the engraving art. In the direction of apparent motion and relative to the direction of light rays emanating from a moving light source, the grooves are progressively angled from an angle of about 90 degrees which corresponds to a region of the zone of maximum illumination through an angle of about 180 degrees corresponding to a region of the zone of minimum illumination. Preferably, sets of grooves of 90 degrees, 120 degrees, 150 degrees and 180 degrees are engraved within each zone or a region of each zone. The grooves which are perpendicular or nearly perpendicular to the light source direction cause a maximum illumination response as light is clearly reflected to the viewer with minimal scattering or dispersion. The grooves which are parallel or nearly parallel to the light source direction cause a minimal illumination response due to the dispersion or scattering of light.

Another aspect of the present invention is that the angles of the groove walls, measured from the perpendicular, are increased with increasing distance of the groove from the light source. For example, grooves nearest the light source may have a groove wall angle of about 30 degrees with grooves farthest from the light source having groove wall angles of about 60 degrees.

In all embodiments of the present invention, the graphic surface may be illuminated along one peripheral edge with a moving light source to produce an illumination response within each zone to thereby create apparent motion between adjacent zones. The step of illuminating the graphic surface with a moving reference of light source may include the use of microprocessor logic circuitry which directs a wave of illumination through a plurality of discrete light source elements such as bulbs. Unlike prior art visual displays, however, the light source elements remain "on" and are not completely extinguished.

In another embodiment of the present invention, the graphic surface is responsive to ambient light and no independent light source is utilized. Rather, the graphic surface is viewed while passing by which produces an illumination response within each zone and thereby creates apparent motion between adjacent zones.

Other advantages and aspects of the invention will become apparent upon making reference to the specification, claims, and drawings to follow.

DETAILED DESCRIPTION OF THE INVENTION

Figure 1:
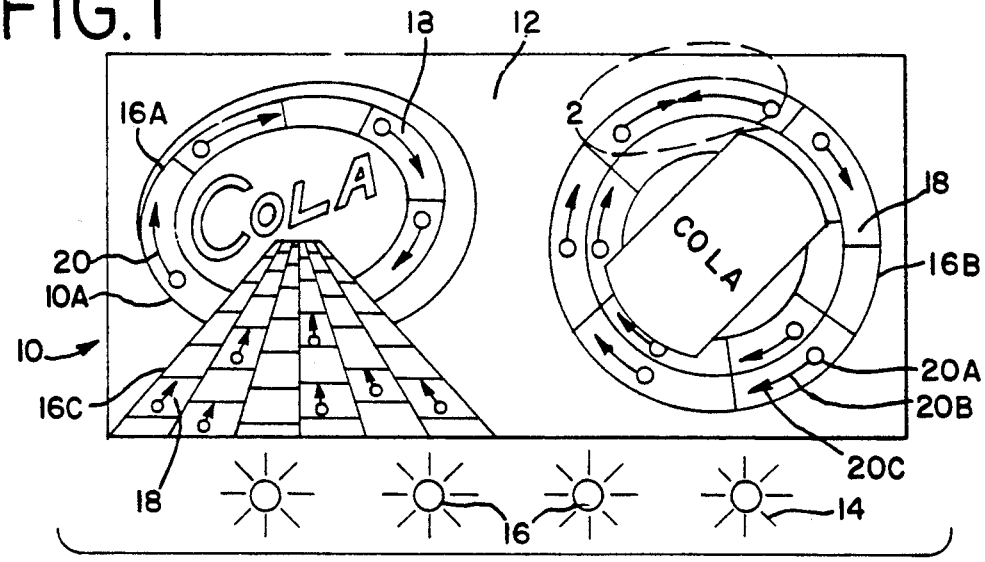
FIG. 1 discloses a tracing for a visual display graphic to create apparent motion made in accordance with the present invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

As used in this disclosure, the term "illumination responsive" is intended to encompass both reflective and refractive surfaces. An example of such reflective surfaces are engraved or embossed foil surfaces used in reflective foil displays. Examples of refractive surfaces are light transmitting materials such as acrylic plastics which are used to achieve light refraction or edge-lit illumination of alpha-numeric indicia.

Referring now to the drawings, FIG. 1 discloses a lay-out drawing or tracing 10A for a visual effect display 10 for conveying apparent motion made in accordance with the present invention. Graphic 10 will have a surface 12 to include certain subject matter which may be especially composed for a suitable purpose, such as the merchandising of a particular product. Graphic 10 will be illuminated by a light source 14 comprised of a plurality of discrete light source elements 16 and which unlike prior art displays, are aligned along only one edge of the display. The mode of operation of light source 14 will be explained later in greater detail.

Graphic 10 is made by first forming a master. The master is produced by devising on the tracing 10A, patterns 16 of the apparent motion to be created when graphic 10 is illuminated. FIG. 1 exemplifies three patterns 16B which call for a double lane of clockwise rotation while pattern 16A requires a single lane of apparent motion. Pattern 16C depicts a ramp of apparent motion following lines of perspective into pattern 16A.

After devising general patterns of apparent motion, the patterns are divided into a plurality of discrete zones 18. The direction of apparent motion to be created within each zone relative to the adjacent zones is then determined by plotting at least one vector 20 within each zone. Each vector 20 comprises a tail represented by a circle 20A, a body 20B and a head or tip 20C. Vectors 20 not only conceptually represent the direction of apparent motion, but vectors 20 also represent a region of each zone 18 to create maximum illumination which progressively diminishes to minimal illumination. Vectors 20 serve as guidance to the later formation of grooves on the surface 12 of graphic 10 which will respond to the light source to produce maximum or minimum illumination. For example, vector tail 20A represents a region of a zone 18 of maximum illumination while vector tip 20C conceptually represents a region of zone 18 of minimal illumination. Vector body 20B represents a region of decreasing illumination.

The speed of apparent motion within a given zone is controlled by the number of vectors plotted within a zone. To increase apparent motion, more than one vector is plotted within a zone in a head-to-tail, tail-to-tail or head-to-head confirmation to conceptually represent selected transitions from maximum illumination response to a minimum illumination response.

Figure 5:
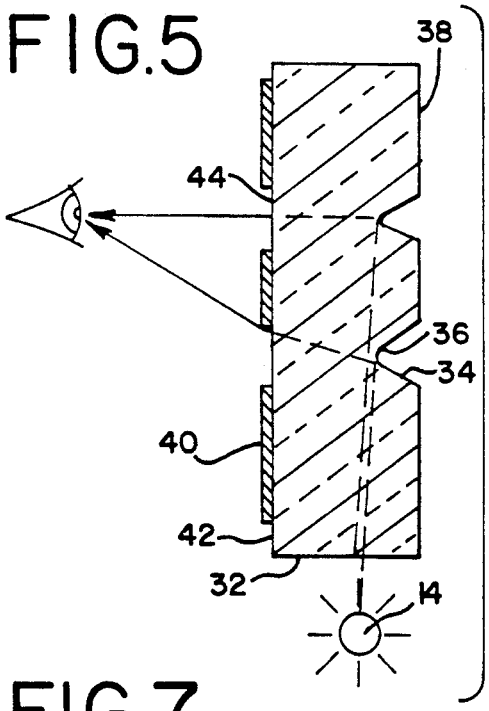
FIG. 5 is an enlarged vertical section of a portion of FIG. 4.

After plotting the vectors within zones to determine the direction and speed of apparent motion on tracing 10A, the tracing 10A is laid on surface 12 of graphic 10. Preferably, the master for graphic 10 is made from a deformable, reflective wax foil such as DUFEX-FOIL TM (Alcan Rorschach AG) or a transparent or translucent acrylic plastic. Engraved into the wax foil are grooves 22 as disclosed in FIG. 2 or embossed with ridges as disclosed in FIG. 5, depending upon the properties of the illumination responsive material which forms surface 12 of graphic 10.

Figure 2:
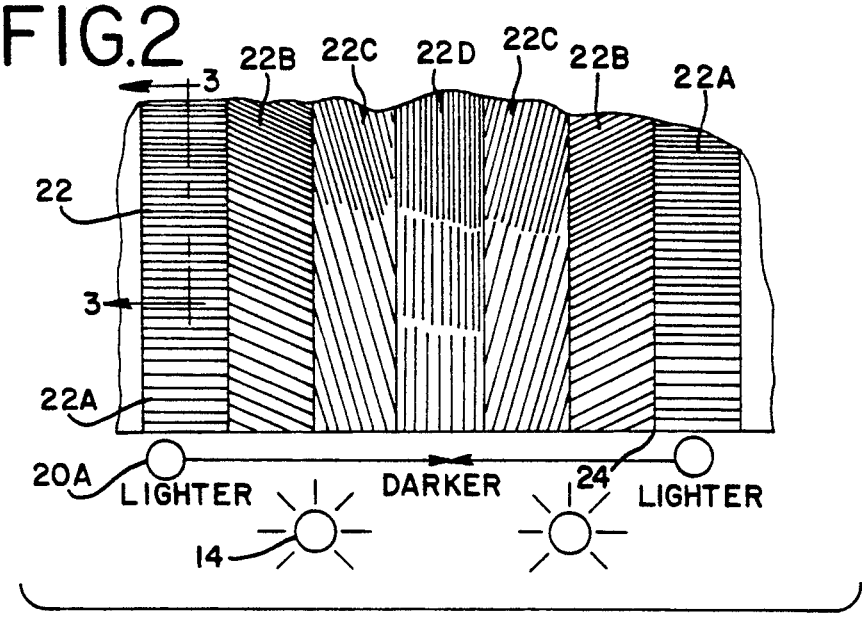
FIG. 2 is an enlarged portion indicated by the dash circle 2 of FIG. 1.

As disclosed in FIG. 2, a region of maximum illumination within a zone, which progressively decreases to a region of minimum illumination is created by forming grooves on the wax foil substrate in which the angles of the groove vary relative to the direction of light rays emanating from the light source. Grooves 22A create an illumination response corresponding to a region of maximum illumination which are schematically represented on tracing 10A as vector tail 20A. In particular, grooves 22A are perpendicular to the direction of light rays emanating from light source 14. Perpendicular grooves 20A cleaning reflect illumination back to a viewer so that the viewer perceives the region bearing grooves 22A as a region of bright illumination. Grooves 22B are increasingly angled relative to the direction of a light source and preferably angled at about 120 degrees. Likewise, grooves 22C are increasingly angled to about 150 degrees relative to the direction of light rays emanating from light source 14. Grooves 22B and 22C less clearly reflect light back to a viewer and thereby cause a perception of diminishing illumination. Finally, grooves 22D are angles 180 degrees or parallel to the direction of light rays emanating from light source 14 so that very little illumination is reflected back to the viewer, but instead are randomly scattered and dispersed. As a result, the viewer perceives the region of grooves 22D to be an area of minimal illumination. Frequent transitions of regions of maximum illumination through minimum illumination and returning to maximum illumination creates the illusion of apparent motion within a particular zone. In some instances, however, a transition as shown in FIG. 2 may be desired, i.e. from maximum illumination through minimum illumination and returning to maximum illumination. The illumination transitions are dictated by the direction and speed of apparent motion as called for by patterns 16.

In making a master of graphic 10, groove sets 22A, 22B, 22C and 22D are formed on the surface of the wax foil substrate by pressing a transparent acetate tool bearing ridges corresponding to the groove angles of a particular groove set. Each tool carries a different groove set, thereby forming the transitions from bright illumination through dark illumination within a particular zone. The process of engraving grooves onto the wax foil surface of the master for graphic 10 continues until all zones as called for by the tracing 10A are completely engraved. Next, it may be desirable to burnish out transition lines 24 as disclosed in FIG. 2 which are formed between each different groove set.

Figure 6:
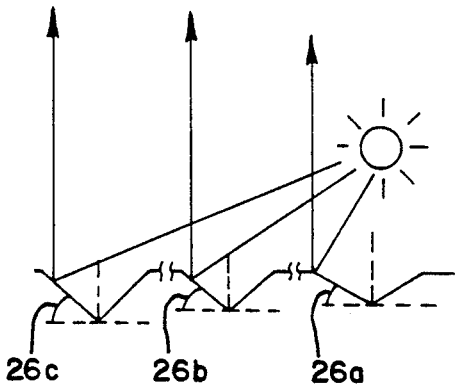
FIG. 6 discloses the increase of groove wall angles as a function of increasing distance of the grooves from the light source; and, FIG. 7 is a graphic illustration of an illumination wave passing through light source elements of the kind used in the practice of the present invention.
Figure 7:
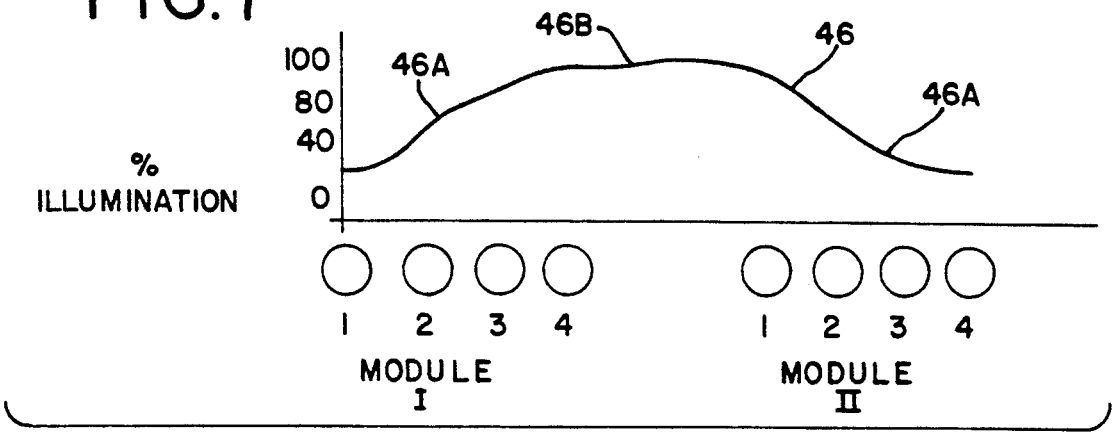

As disclosed in FIG. 6, a variety of grooves having different groove wall angles, when measured from the perpendicular, are used depending upon the distance of the grooves from a light source. For example, and as disclosed in FIG. 6, grooves 22 which are nearest to the light source have a groove wall angle 26A of about 30 degrees. Grooves located an intermediate distance from a light source have a groove wall angle 26B preferably of about 45 degrees, whereas grooves positioned furthest from the light source have a groove wall angle preferably of about 55–60 degrees. The variance of groove wall angles as a function of distance of the grooves from the light source is required in order for the illumination response produced by the grooves to remain consistent over the entire surface of graphic 10. The necessity for varying the groove wall angle is even more critical since the present invention contemplates a light source aligned only one peripheral edge of a graphic as is disclosed in FIG. 1.

Figure 3:
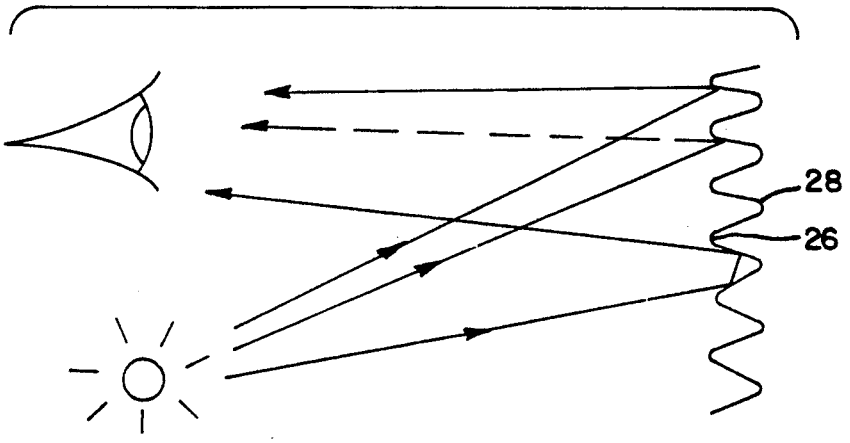
FIG. 3 is an enlarged vertical section view taken along line 3—3 of FIG. 2.

FIG. 3 discloses a sectional view of the preferred configuration of grooves 22 utilizing the practice of the present invention. Crests 26 and troughs 28 of each groove 22 are eased or rounded which creates the perception of more evenly flowing apparent motion. Were the crests and troughs of grooves 22 sharp in accordance with prior art displays, then an uneven perception of apparent motion is created.

In addition, it has been found that to create well defined angles of reflection to a viewer, the depth of grooves 22 should be increased over that of the prior art. Typically, prior art grooves engraved on light reflected foil surfaces have depth of about 0.0015 inches, whereas the grooves in accordance with the present invention should range from 0.002 through 0.003 inches. As known in the engraving field, when a master is used in the process of creating prototype graphics and in the eventual formation of a tool for manufacturing runs of the graphics, the overall depth of the engraved grooves becomes shallower. Hence, by forming prototype grooves of sufficient depth, the clarity of apparent motion and other visual effects created by the graphic can be maintained.

Also, it has been found that if the surface of the graphic to be produced is relatively small, or subject matter of the graphic requires even-flowing apparent motion, such as in depicting flowing water or waving flags, a greater number of grooves per linear inch is required, typically on the order of 150 grooves per linear inch. On the other hand, if a merchandising display of a large surface area is used or the subject matter of the graphic requires more stark definition, such as a stroboscopic effect, then fewer grooves per linear inch are utilized such as on the order of about 100 grooves per linear inch. Likewise, if a certain portion of the subject matter of a graphic is to remain stationary, that is, without creating the illusion of apparent motion, then the grooves are all oriented relative to light source direction in a single angle, most typically at 90 degrees or perpendicular to the direction of light rays emanating from the light source.

After engraving of the wax foil substrate has been completed, thereby creating master of the graphic, the master is then coated with a composition consisting of a blend of acetate gum and liquid acetate. After the acetate composition has set, a mirror image transparent roll-out plate of the master is formed. The roll-out plate can be used to create 100 prototype reproductions of the master. These prototypes are used to assure proper functioning of the graphic.

If the graphic is found to be suitable, then the master is inserted into a nickel-electroplating bath in which the master is juxtaposed to a tool on which is eventually formed nickel-plated ridges. These ridges correspond to the grooves on the master. After formation of nickel-plated tool, the tool is then used to create multi-colored foil graphics through use of hot-stamping techniques known in the foil graphics art.

Figure 4:
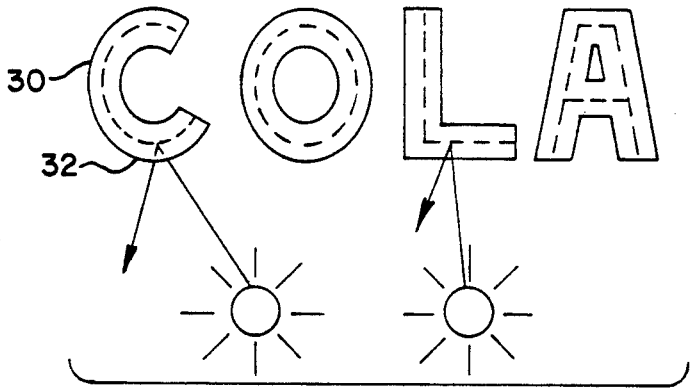
FIG. 4 is another embodiment of the present invention practiced on illumination responsive lettering.

FIG. 4 disclosed another embodiment of the present invention in which alphanumeric indicia or other subject matter, preferably carried on transparent or translucent plastic material such as acrylic, may be suspended in front of graphic surface 12. In particular, FIG. 4 discloses such indicia 30 which are edge-illuminated through transmission of illumination through peripheral edges 32 of indicia 30. As light passes through a peripheral edge 32 of indicia 30, it travels through indicia 30 until striking a groove wall 34 of a groove 36 which is etched on backside surface 38 of indicia 30. To create regions of maximum illumination through a minimum of illumination, the grooves may be angled in a range of 90 degrees through 180 degrees relative to the direction of the light rays passing through the peripheral edge 32 of indicia 30. Such refraction and transmission of light through indicia 30 creates the illusion of indicia 30 having brightly lit or glowing peripheral edges. A starkly-contrasting "neon" effect can be created on such lettering by selective silk screening of opaque regions 40 on outer surface 42 of indicia 30 thus defines windows 44 for transmission of refracted light.

Finally, FIG. 6 diagrammatically discloses an illumination wave passing through discrete light element sources 16 of a light source 14. Illumination wave 46 is characterized by having a receding portion and a preceding portion 46A of minimal illumination and a crest 46B representing maximum illumination of light element 16. Hence, unlike the "marquee-chaser" illumination sources for prior art visual displays, the light systems elements as used in the practice of the present invention remain "on", albeit in varying degrees of illumination, but are never completely extinguished. It has also been determined that where a greater number of grooves per linear inch are utilized on a graphic surface, then a greater number of individual lighting elements in the light source should be utilized. On the other hand, where a starkly contrasting display is desired creating the perception of less flowing apparent motion, then a fewer number of lighting elements are utilized. Microprocessor logic circuitry is used for specialized control of light source 14.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. A method of creating apparent motion on a two-dimensional surface, the surface being illumination responsive to a directed moving reference of light source, the method comprising the steps of:

devising a pattern of apparent motion to be created on the surface;

dividing a pattern of apparent motion to be created on the surface;

dividing the pattern into a plurality of discrete and spatially related zones;

determining a direction of apparent motion to be created within each one of said zones and relative to adjacent ones of said zones;

transferring the pattern and zones thereof onto the surface;

forming on the surface a plurality of contiguous regions within each of said zones, each of said regions consisting of a plurality of parallel grooves completely covering said regions, each of said contiguous regions being in proximate relationship with adjacent ones of said contiguous regions so as to permit no ungrooved spaces therebetween, the grooves in each of said regions in one of said zones being progressively angled relative to the grooves in adjacent ones of said regions within said one of said zones;

aligning said directed moving reference of light source along only one edge of said surface, said light source including a plurality of discrete light elements; and, illuminating the surface with the directed moving reference of light source to produce at least one illumination response within each zone and thereby creating apparent motion between adjacent zones.

2. The method of claim 1 wherein the regions produce a decreasing illumination response in the direction of apparent motion so that relative to the directed moving reference of light source a maximum illumination response is perceived at about a 90° angle and illumination response decreases with increasing angles until a minimum illumination response is perceived at about a 180° angle.

3. The method of claim 1 wherein the step of determining a direction of apparent motion within each zone further includes; determining a speed of apparent motion to be created within each zone.

4. The method of claim 1 wherein the step of forming on the surface of a plurality of grooves includes; engraving in a deformable illumination responsive substrate a plurality of sets of grooves, each set being angled differently relative to the directed moving reference of light source.

5. The method of claim 4 wherein the directed moving reference of light source defines a line and, a first region of grooves has an angle of about 90° relative to said line, a second region of grooves has an angle of about 120° relative to said line, a third region of grooves has an angle of about 150° relative to said line, and a fourth region of grooves has an angle of about 180° relative to said line.

6. A light reflective graphic made in accordance with the method of claim 1.

7. The graphic of claim 6 further including a deformable foil graphic.

8. An indicia having illumination responsive peripheral edges made in accordance with the method of claim 1.

9. The method of claim 1 wherein the step of forming on the surface a plurality of grooves further including the step of:

forming grooves having groove walls being increasingly angled from the perpendicular with increasing distance of each zone surface from the directed moving reference of light source.

10. The method of claim 9 wherein the groove wall angles range from about 30 degrees for grooves nearest the directed moving light source through about 60 degrees for grooves farthest from the directed moving reference of light source.

11. A two-dimensional illumination responsive graphic display, the display creating the illusion of apparent motion when illuminated by a directed moving reference of light source, comprising:

a graphic display surface having plotted thereon at least one pattern of apparent motion to be created, wherein said directed moving reference of light source being aligned along only one edge of said surface, said light source including a plurality of light elements;

a plurality of discrete and spatially related zones divided from the pattern, each of said zones conveying differing directions of apparent motion; and a plurality of contiguous regions within each of said zones, each of said regions consisting of a plurality of parallel grooves completely covering said regions, each of said contiguous regions being in proximate relationship with adjacent ones of said contiguous regions so as to permit no ungrooved spaces therebetween, the grooves in each of said regions in one of said zones being progressively angled relative to the grooves in adjacent ones of said region within said one of said zones.

* * * * *

UNITED STATES PATENT AND TRADEMARK OFFICE

CERTIFICATE OF CORRECTION

PATENT NO. : 5,168,646

DATED : December 8, 1992

INVENTOR(S) : John Dippong and Gerald R. Sorensen

It is certified that error appears in the above-identified patent and that said Letters Patent is hereby corrected as shown below:

At Column 7, please delete lines 34 and 35.

Signed and Sealed this

Twelfth Day of April, 1994

Bruce Lehman

*Attest:*

BRUCE LEHMAN

*Commissioner of Patents and Trademarks*

*Attesting Officer*